US009845098B2

(12) United States Patent
Nishimura et al.

(10) Patent No.: US 9,845,098 B2
(45) Date of Patent: Dec. 19, 2017

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 189 days.

(21) Appl. No.: 14/759,502

(22) PCT Filed: Jan. 6, 2014

(86) PCT No.: PCT/JP2014/000005
§ 371 (c)(1),
(2) Date: Jul. 7, 2015

(87) PCT Pub. No.: WO2014/109279
PCT Pub. Date: Jul. 17, 2014

(65) Prior Publication Data

US 2015/0344046 A1 Dec. 3, 2015

(30) Foreign Application Priority Data

Jan. 10, 2013 (JP) ..... 2013-002734

(51) Int. Cl.
*B61F 5/26* (2006.01)
*B61F 5/52* (2006.01)
*B61F 5/30* (2006.01)

(52) U.S. Cl.
CPC ..... *B61F 5/26* (2013.01); *B61F 5/302* (2013.01); *B61F 5/305* (2013.01); *B61F 5/52* (2013.01)

(58) Field of Classification Search
CPC ..... B61F 3/00; B61F 3/02; B61F 5/00; B61F 5/02; B61F 5/26; B61F 5/28; B61F 5/30;
(Continued)

(56) References Cited

U.S. PATENT DOCUMENTS 4,332,201 A 6/1982 Pollard et al.
4,648,326 A 3/1987 Jackson
(Continued)

FOREIGN PATENT DOCUMENTS

CN 1066687 C 6/2001
EP 2733041 A1 5/2014
(Continued)

OTHER PUBLICATIONS

Aug. 26, 2016 Extended Search Report issued in European Patent Application No. 14737607.3.
(Continued)

*Primary Examiner* — R. J. McCarry, Jr.
(74) *Attorney, Agent, or Firm* — Oliff PLC

(57) ABSTRACT

A railcar bogie includes: a bogie frame including a cross beam supporting a carbody of a railcar; a pair of axles respectively arranged at both sides of the cross beam in a car longitudinal direction and extending in a car width direction; bearings provided at both car width direction sides of each of the axles and rotatably supporting the axles; axle boxes respectively accommodating the bearings; and coupling devices coupling the axle boxes and the bogie frame to one another, each of the coupling devices including a first member projecting from the axle box to the bogie frame, a second member projecting from the bogie frame to the first member, and a coupling portion coupling the first member and the second member to each other, and the second member being formed separately from the bogie frame and positioned by contacting the bogie frame.

6 Claims, 8 Drawing Sheets

(58) Field of Classification Search
CPC ..... B61F 5/301; B61F 5/302; B61F 5/305; B61F 5/32
See application file for complete search history.

(56) References Cited

U.S. PATENT DOCUMENTS

| | | | | |
|---|---|---|---|---|
| 5,107,772 | A | 4/1992 | Viens | |
| 7,328,660 | B2 * | 2/2008 | Landrot | B61F 5/305 105/218.2 |

FOREIGN PATENT DOCUMENTS

| | | | |
|---|---|---|---|
| JP | H01160777 | A | 6/1989 |
| JP | H04-119266 | A | 4/1992 |
| JP | H0623864 | U | 3/1994 |
| JP | 2511120 | B2 | 6/1996 |
| JP | H1191559 | A | 4/1999 |
| KR | 10-0190206 | B1 | 6/1999 |

OTHER PUBLICATIONS

Oct. 27 2015 Office Action issued in Taiwanese Patent Application No. 103100791.
Apr. 8, 2014 International Search Report issued in International Application No. PCT/JP2014/000005.

* cited by examiner

RAILCAR BOGIE

TECHNICAL FIELD

The present invention relates to a bogie supporting a carbody of a railcar.

BACKGROUND ART

A bogie for supporting a carbody of a railcar and allowing the railcar to run along a rail is provided under a floor of the carbody. In the bogie, axle boxes each configured to accommodate a bearing for supporting a wheelset are supported by axle box suspensions so as to be displaceable relative to a bogie frame in an upper/lower direction. For example, in PTL 1, the bogie frame includes a cross beam extending in a lateral direction and a pair of left and right side sills respectively extending from both end portions of the cross beam in a front/rear direction. The axle boxes accommodating the bearings for the axles are supported on the bogie frame by axle beam type axle box suspensions. According to the axle beam type axle box suspension, the axle box and the side sill are coupled to each other in such a manner that a tip end portion of an axle beam projecting integrally from the axle box is elastically coupled to an attaching portion formed integrally with the side sill.

CITATION LIST

Patent Literature

PTL 1: Japanese Laid-Open Patent Application Publication No. 1-160777

SUMMARY OF INVENTION

Technical Problem

According to the bogie of PTL 1, the attaching portion to which the tip end portion of the axle beam is elastically coupled is formed integrally with the side sill. However, once the attaching portion is integrated with the side sill by welding or the like, the position of the attaching portion cannot be adjusted. Therefore, for example, an accumulated dimension error of parts which is generated when assembling the bogie may become large. On this account, producing the bogie with a high degree of accuracy requires skill.

An object of the present invention is to easily produce a bogie with a high degree of accuracy.

Solution to Problem

A railcar bogie according to the present invention includes: a bogie frame including a cross beam supporting a carbody of a railcar; a pair of axles respectively arranged at both sides of the cross beam in a car longitudinal direction and extending in a car width direction; bearings provided at both car width direction sides of each of the axles and rotatably supporting the axles; axle boxes respectively accommodating the bearings; and coupling devices coupling the axle boxes and the bogie frame to one another, each of the coupling devices including a first member projecting from the axle box to the bogie frame, a second member projecting from the bogie frame to the first member, and a coupling portion coupling the first member and the second member to each other, and the second member being formed separately from the bogie frame and positioned by contacting the bogie frame.

According to the above configuration, the second member projecting from the bogie frame toward the first members is formed separately from the bogie frame and is positioned by contacting the car width direction end portion of the bogie frame. Therefore, as compared to a case where the second member is formed integrally with the bogie frame, for example, an accumulated dimension error of the parts of the bogie can be easily adjusted. Thus, the bogie can be easily produced with a high degree of accuracy.

Advantageous Effects of Invention

As is clear from the above explanations, according to the present invention, the bogie can be easily produced with a high degree of accuracy.

DESCRIPTION OF EMBODIMENTS

Hereinafter, an embodiment will be explained in reference to the drawings.

Figure 1:
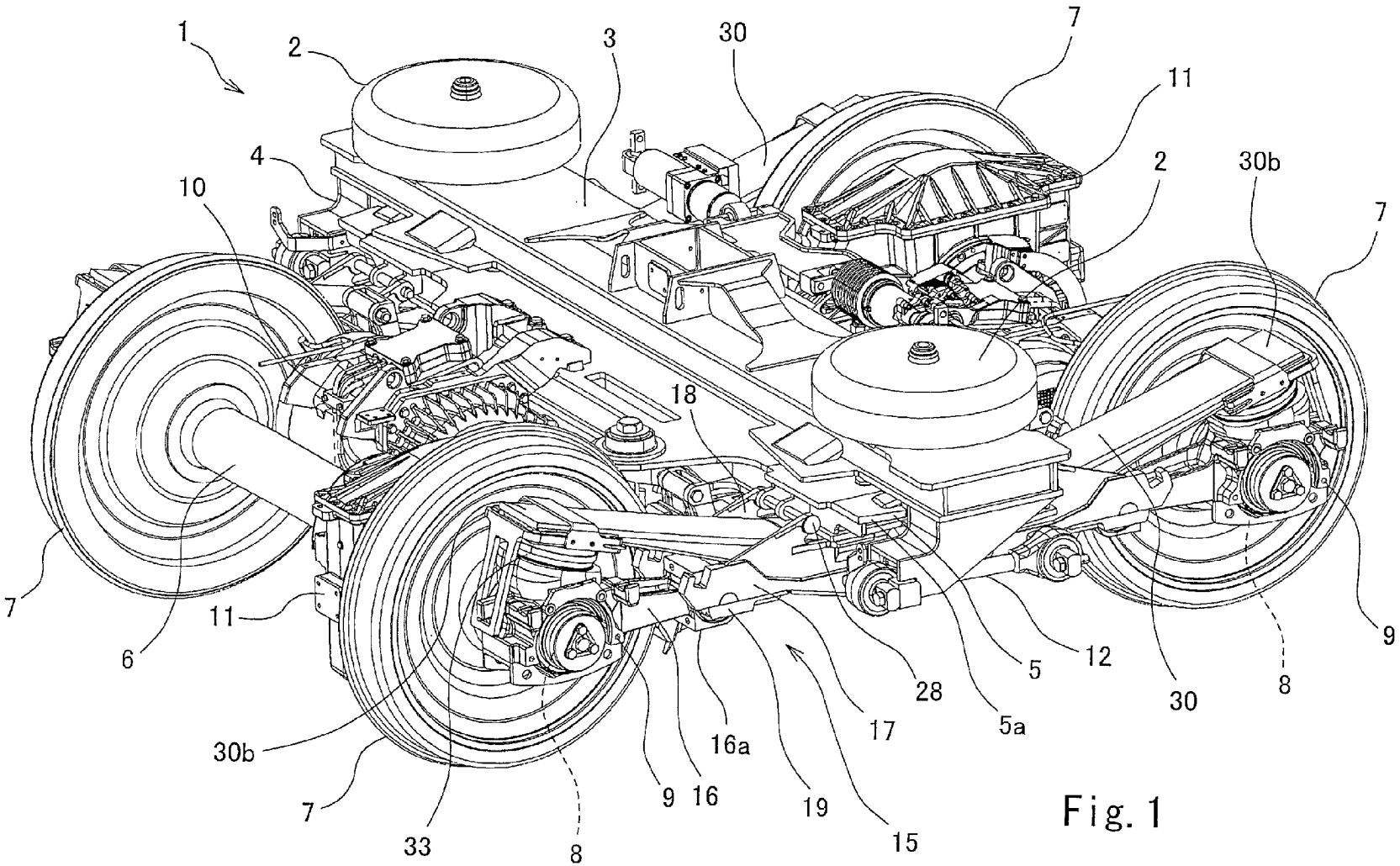
FIG. 1 is a perspective view showing a railcar bogie according to an embodiment.
Figure 2:
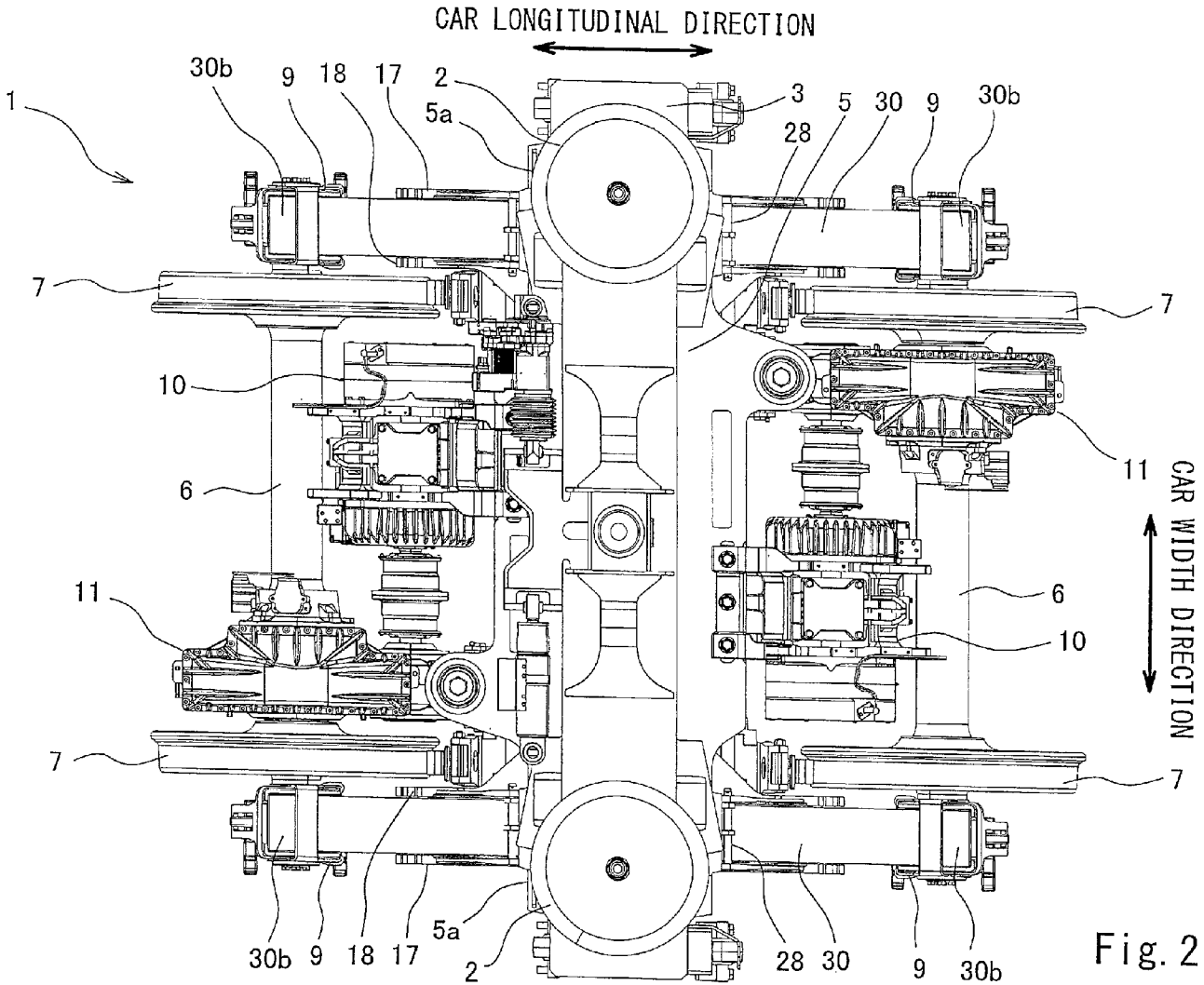
FIG. 2 is a plan view of the bogie shown in FIG. 1.
Figure 3:
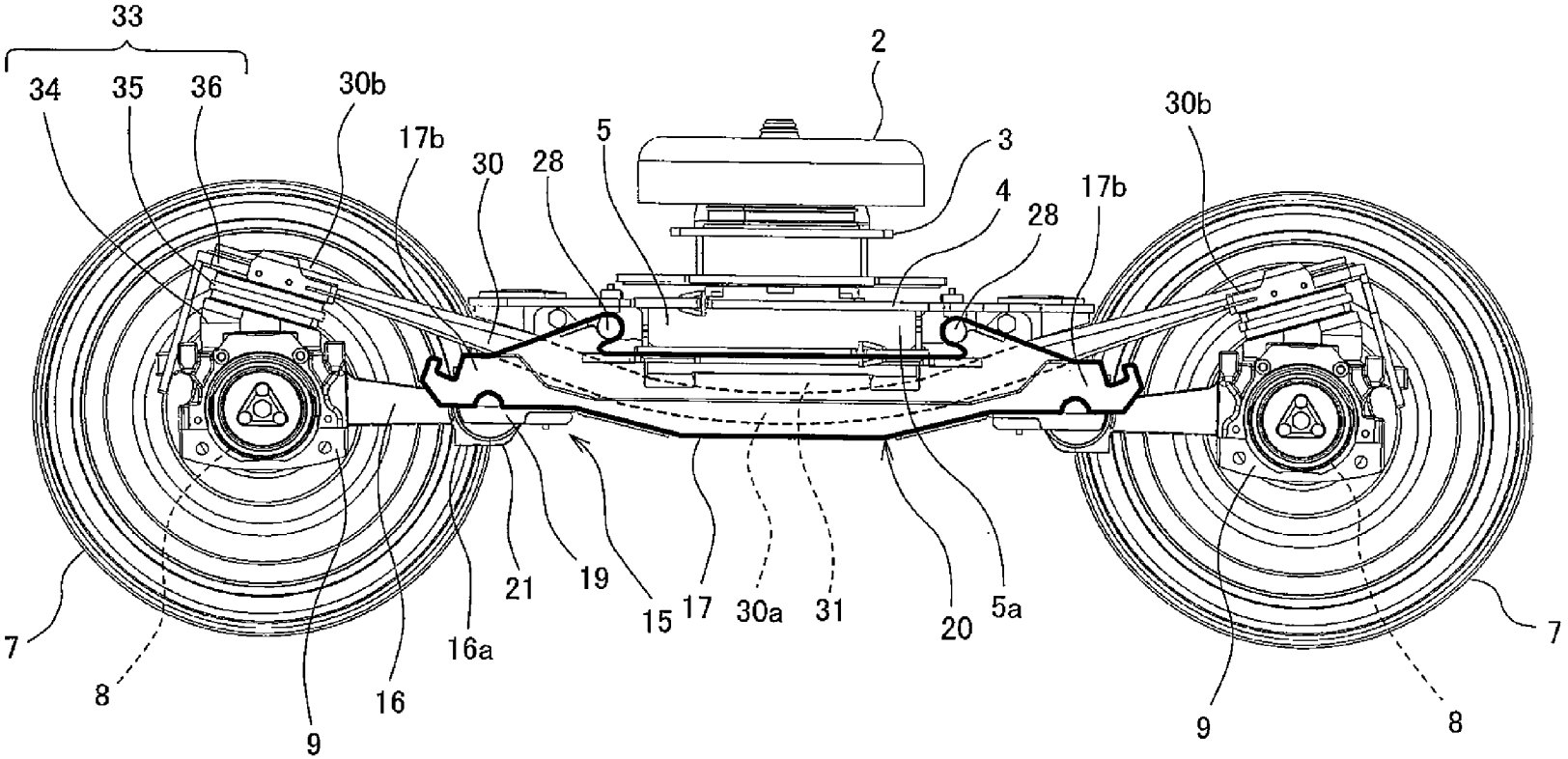
FIG. 3 is a side view of the bogie shown in FIG. 1 (an electric motor, a reducer, and the like are not shown).

FIG. 1 is a perspective view showing a railcar bogie 1 according to the embodiment. FIG. 2 is a plan view of the bogie 1 shown in FIG. 1. FIG. 3 is a side view of the bogie 1 shown in FIG. 1. As shown in FIGS. 1 to 3, the bogie 1 for a railcar includes a bogie frame 4. The bogie frame 4 supports a carbody (not shown) via air springs 2 and a bolster 3, the air springs 2 serving as secondary suspensions. The bogie frame 4 includes a cross beam 5. The cross beam 5 extends in a car width direction that is a left/right direction and supports the carbody. However, unlike the configuration of a conventional railcar bogie, the bogie frame 4 does not include side sills which respectively extend from both car width direction end portions of the cross beam 5 in a car longitudinal direction that is a front/rear direction. The cross beam 5 is connected to the bolster 3 via a center plate (not shown) and a center pin (not shown) so as to be able to swivel. The bolster 3 is connected to the carbody (not shown) via the air springs 2 and bolster anchors 12. A pair of front and rear axles 6 are respectively arranged in front of and behind the cross beam 5 so as to extend in the car width direction. Wheels 7 are respectively fixed to both car width direction sides of each axle 6. Bearings 8 are respectively provided at both car width direction end portions of each axle 6 so as to be located outside the wheels 7 in the car width direction. The bearings rotatably support the axles 6. The bearings 8 are respectively accommodated in axle boxes 9. Electric motors 10 are attached to the cross beam 5. Gear boxes 11 are respectively connected to output shafts of the electric motors 10. Each of the gear boxes 11 accommodates reduction gears which transmit power to the axle 6.

Each of plate springs 30 extending in the car longitudinal direction is provided between the cross beam 5 and the axle box 9. Longitudinal direction middle portions 30*a* of the plate springs 30 respectively support both car width direction end portions 5*a* of the cross beam 5. Both longitudinal direction end portions 30*b* of each of the plate springs 30 are respectively supported by the axle boxes 9. To be specific, each of the plate springs 30 serves as both a primary suspension and a conventional side sill. The middle portions 30*a* of the plate springs 30 are arranged under the cross beam 5. Pressing members 31 are respectively provided under the car width direction end portions 5*a* of the cross beam 5. Each of the pressing members 31 is provided between a pair of receiving seats 17 and 18 described below and has a circular-arc lower surface. The pressing members 31 are respectively disposed on the middle portions 30*a* of the plate springs 30 from above so as to respectively, freely contact the middle portions 30*a*. To be specific, the pressing members 31 respectively contact upper surfaces of the plate springs 30 by a downward load from the cross beam 5 due to gravity so as not to fix the plate springs 30 in the upper/lower direction.

Spring seats 33 are respectively attached to upper portions of the axle boxes 9. The end portions 30*b* of the plate springs 30 are respectively disposed on the spring seats 33 from above so as to respectively, freely contact the spring seats 33. Each of the spring seats 33 includes an inclined member 34, a gap body 35, and a receiving member 36. The inclined member 34 is positioned on the axle box 9, and an upper surface of the inclined member 34 is inclined toward a longitudinal direction middle side. The gap body 35 is positioned on the inclined member 34 and has elasticity. The receiving member 36 is positioned on the gap body 35, and the end portion 30*b* of the plate spring 30 is placed on the receiving member 36. Upper surfaces of the end portions 30*b* of each of the plate springs 30 are inclined in a direction toward the middle portion 30*a*. The middle portion 30*a* of the plate spring contacts a lower surface of the pressing member 31 and has a circular-arc shape. To be specific, the middle portion 30*a* is located under the end portions 30*b*, and the entire plate spring 30 has a bow shape that is convex downward in a side view.

The axle boxes 9 are coupled to the car width direction end portions 5*a* of the cross beam 5 by coupling devices 15 serving as axle box suspensions. Each of the coupling devices 15 includes axle beams 16 (first members), a receiving seat unit 20 (second member), and coupling portions 19. Each of the axle beams 16 projects integrally from the axle box 9 toward the cross beam 5. The receiving seat unit 20 projects from the cross beam 5 toward the axle beams 16. Each of the coupling portions 19 couples a tip end portion 16*a* of the axle beam 16 to the receiving seat unit 20. To be specific, the coupling device 15 of the present embodiment is an axle beam type device. A part of the plate spring 30 is arranged at a position overlapping the receiving seat unit 20 in a side view. The plate spring 30 is arranged so as to be spaced apart from the receiving seat unit 20. The plate spring 30 extends through a space between the receiving seats 17 and 18 of the receiving seat unit 20 to a position under the cross beam 5.

Figure 4:
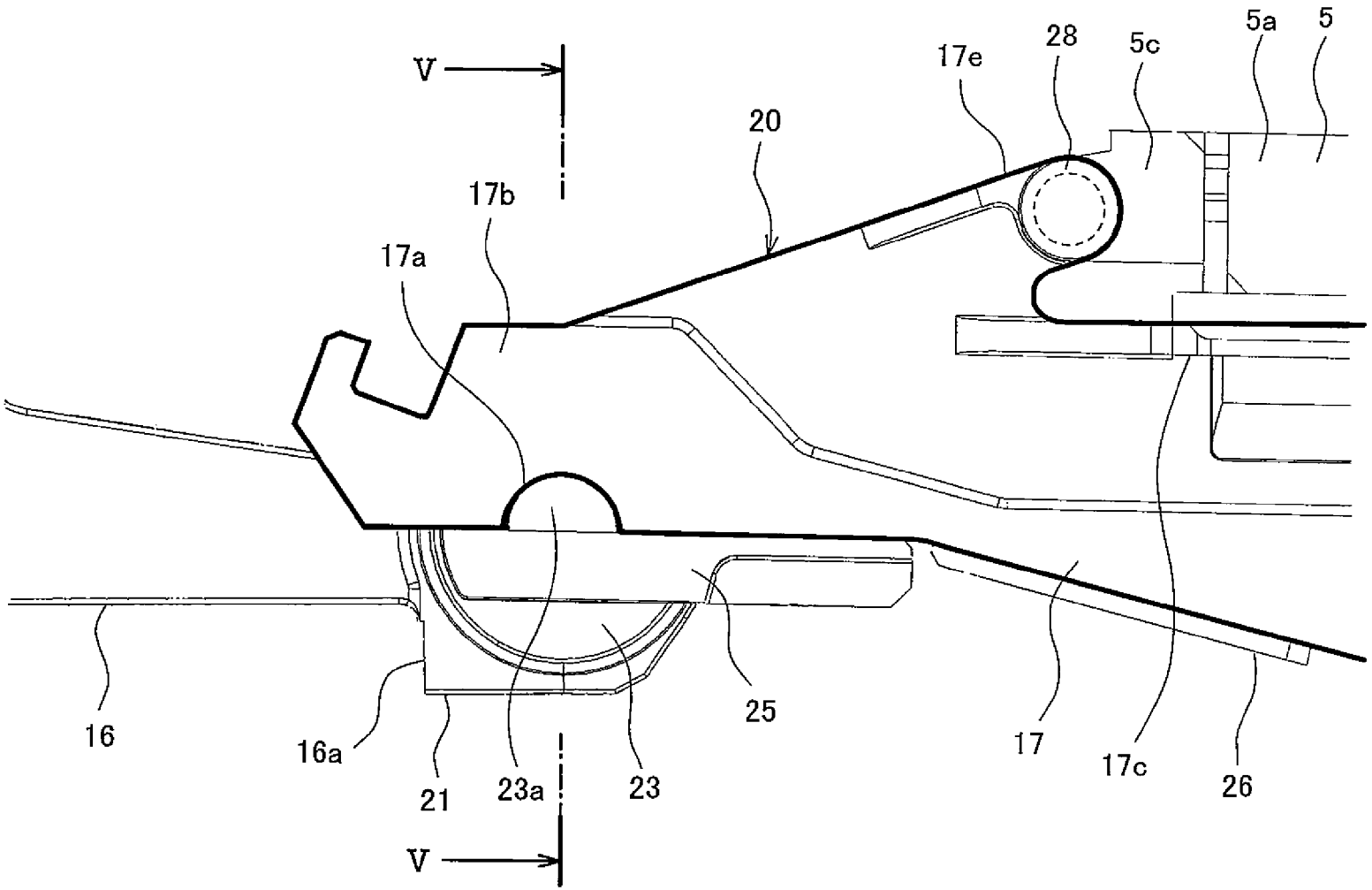
FIG. 4 is an enlarged side view of major portions of the bogie shown in FIG. 3.
Figure 5:
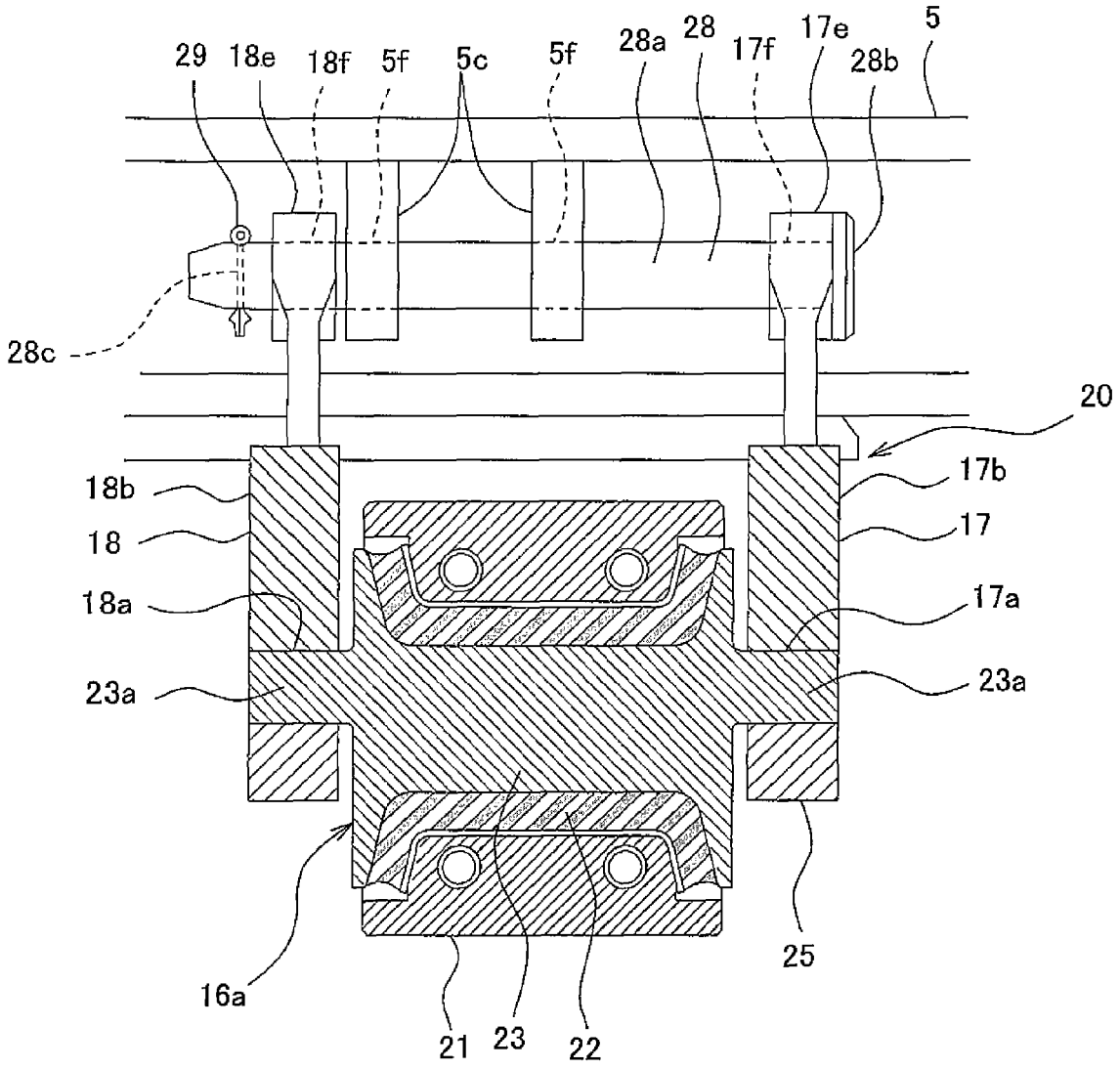
FIG. 5 is a cross-sectional view taken along line V-V of FIG. 4.
Figure 6:
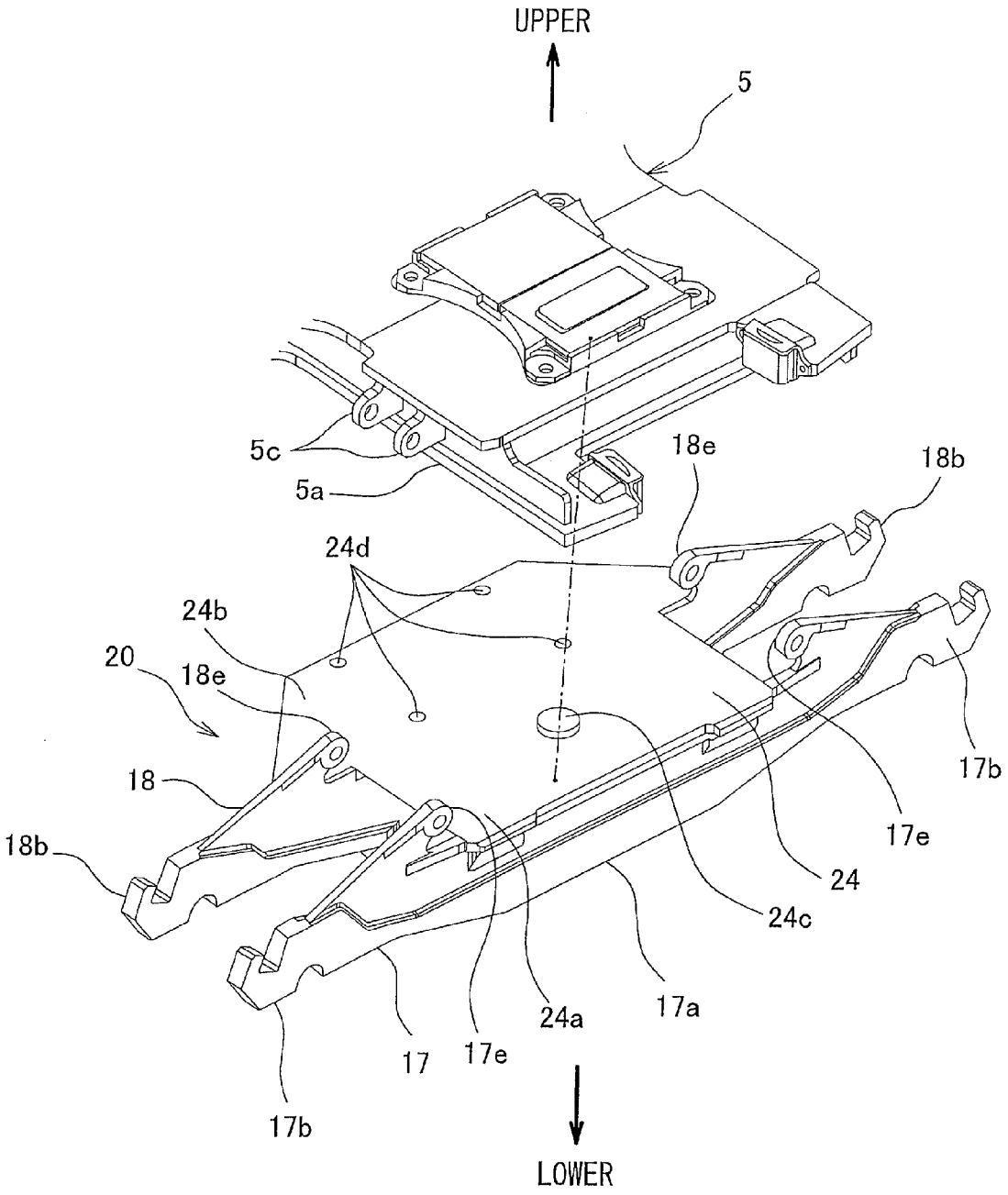
FIG. 6 is an exploded perspective view for explaining positioning between a receiving seat unit and a cross beam in the bogie shown in FIG. 3, when viewed from above.
Figure 7:
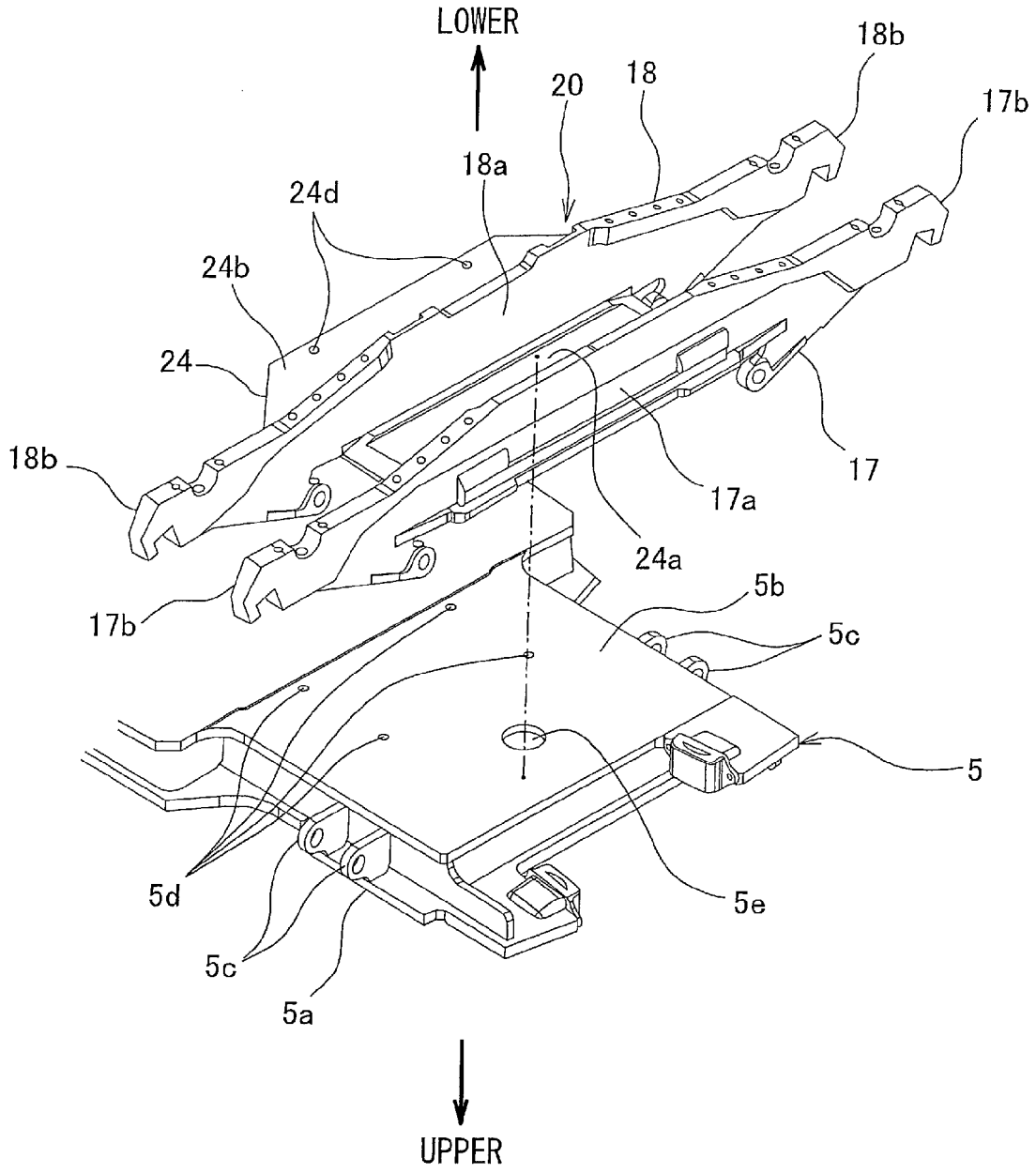
FIG. 7 is an exploded perspective view for explaining the positioning between the receiving seat unit and the cross beam in the bogie shown in FIG. 3, when viewed from below.
Figure 8:
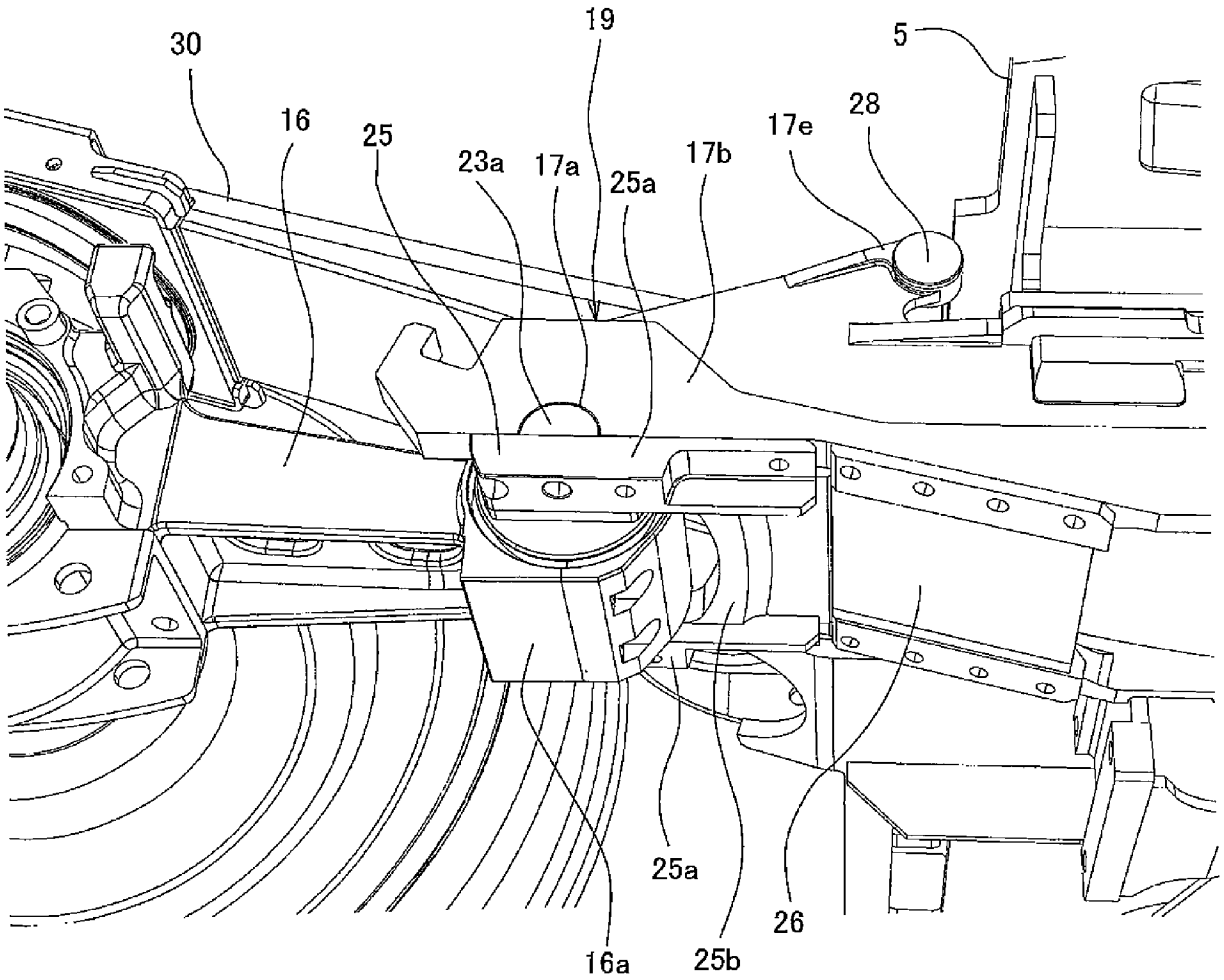
FIG. 8 is a perspective view showing the major portions of the bogie shown in FIG. 3 (a plate spring and the like are not shown), when viewed from an obliquely lower side of an inside of the bogie.

FIG. 4 is an enlarged side view of major portions of the bogie 1 shown in FIG. 3. FIG. 5 is a cross-sectional view taken along line V-V of FIG. 4. FIG. 6 is an exploded perspective view for explaining positioning between the receiving seat unit 20 and the cross beam 5 in the bogie 1 shown in FIG. 3, when viewed from above. FIG. 7 is an exploded perspective view for explaining the positioning between the receiving seat unit 20 and the cross beam 5 in the bogie 1 shown in FIG. 3. FIG. 8 is a perspective view showing major portions of the bogie 1 shown in FIG. 3, when viewed from an obliquely lower side of an outside of the bogie. As shown in FIGS. 3 to 8, the receiving seat unit 20 is located under the end portion 5*a* of the cross beam 5 and extends in the car longitudinal direction (a thick line in each of FIGS. 3 and 4 shows the outline of the receiving seat unit 20). The receiving seat unit 20 is formed separately from the cross beam 5 and is not fixed to the cross beam 5 by welding. The receiving seat unit 20 contacts the cross beam 5 and is positioned by the cross beam 5. The receiving seat unit 20 includes the receiving seats 17 and 18 and a connecting plate 24. The receiving seats 17 and 18 are a pair of vertical plates and located under the end portion 5*a* of the cross beam 5. The receiving seats 17 and 18 extend in the car longitudinal direction and are arranged so as to be spaced apart from each other in the car width direction. The connecting plate 24 is a horizontal plate and is joined to the receiving seats 17 and 18 so as to couple the receiving seats 17 and 18 to each other.

As shown in FIGS. 3 and 4, a lower portion of each of the receiving seats 17 and 18 is thicker than an upper portion of each of the receiving seats 17 and 18. Both longitudinal direction end portions 17*b* of the receiving seat 17 respectively project toward the axle beams 16 (axle boxes 9) respectively located at both car longitudinal direction sides of the cross beam 5, and both longitudinal direction end portions 18*b* of the receiving seat 18 respectively project toward the axle beams 16 (axle boxes 9) respectively located at both car longitudinal direction sides of the cross beam 5. One of the end portions 17*b* of the receiving seat 17 is coupled to one of the axle beams 16, and the other end portion 17*b* of the receiving seat 17 is coupled to the other axle beam 16. One of the end portions 18*b* of the receiving seat 18 is coupled to one of the axle beams 16, and the other end portion 18*b* of the receiving seats 18 is coupled to the other axle beam 16. Specifically, as shown in FIG. 5, a tubular portion 21 is provided at the tip end portion 16*a* of the axle beam 16. An inner peripheral surface of the tubular portion 21 has a cylindrical shape, and both car width direction sides of the tubular portion 21 are open. A bobbin-shaped core rod 23 is inserted through an internal space of the tubular portion 21 via a rubber bushing 22. Fitting grooves 17*a* are respectively formed at both longitudinal direction end portions of the receiving seat 17 so as to be open downward. Fitting grooves 18*a* are respectively formed at both longitudinal direction end portions of the receiving seat 18 so as to be open downward. The core rod 23 includes protruding portions 23*a*. The protruding portions 23*a* respectively project toward both car width direction sides and each has a semi-circular cross section. The protruding portions 23*a* are respectively fitted in the fitting grooves 17*a* and 18*a* from below. In this state, a lid member 25 is fixed to lower end surfaces of the receiving seats 17 and 18 by bolts (not shown) form below so as to close the lower openings of the fitting grooves 17*a* and 18*a*. Thus, the core rod 23 is supported by the lid member 25 from below. To be specific, the protruding portions 23*a* of the core rod 23, the fitting grooves 17*a* and 18*a* of the receiving seats 17 and 18, and the lid member 25 constitute the coupling portion 19.

As shown in FIGS. 6 and 7, the connecting plate 24 of the receiving seat unit 20 includes a base plate portion 24*a* and a projecting plate portion 24*b*. The base plate portion 24*a* extends between upper ends of the receiving seats 17 and 18. The projecting plate portion 24*b* projects from the base plate portion 24*a* toward a car width direction inner side. The base plate portion 24*a* is shorter than each of the receiving seats 17 and 18 in the car longitudinal direction. The projecting plate portion 24*b* is longer than the base plate portion 24*a* in the car longitudinal direction. The projecting plate portion 24*b* includes a portion contacting a car width direction inner side surface of the receiving seat 18 located at the car width direction inner side. A fitting portion 24*c* is formed on an upper surface of the base plate portion 24*a*. The fitting portion 24*c* is a convex portion projecting upward. A fitted portion 5*e* is formed on a lower surface of the cross beam 5, the lower surface being opposed to the fitting portion 24*c*. The fitted portion 5*e* is a concave portion in which the fitting portion 24*c* is fitted. A plurality of bolt holes 24*d* are formed on the projecting plate portion 24*b*. A plurality of bolt hole 5*d* are formed on positions of the cross beam 5, the positions respectively overlapping the bolt holes 24*d*. The receiving seat unit 20 is attached to the cross beam 5 in such a manner that: the fitting portion 24*c* is positioned by being fitted in the fitted portion 5*e*; and bolts (not shown) are fastened to the bolt holes 24*d* and 5*d*. The pressing member 31 (see FIG. 3) placed on the middle portion 30*a* of the plate spring 30 from above is attached to a lower surface of the base plate portion 24*a*.

As shown in FIGS. 4 to 7, a pair of brackets 5*c* project from each of both car longitudinal direction side surfaces (front and rear surfaces) of the cross beam 5. The brackets 5*c* are provided with pin holes 5*f* each having an axis extending in the car width direction. Bracket portions 17*e* are integrally formed at the receiving seat 17 and respectively provided with pin holes 17*f* each having the same axis as the pin hole 5*d*. Bracket portions 18*e* are integrally formed at the receiving seat 18 and respectively provided with pin holes 18*f* each having the same axis as the pin hole 5*f*. Pins 28 are inserted into the pin holes 5*f* of the brackets 5*c* and the pin holes 17*f* and 18*f* of the bracket portions 17*e* and 18*e*. Each of the pins 28 includes a shaft portion 28*a*, a head portion 28*b*, and a through hole 28*c*. The shaft portion 28*a* does not have screw threads. The head portion 28*b* is formed at one of end portions of the shaft portion 28*a*. The through hole 28*c* is formed at the other end portion of the shaft portion 28*a* so as to extend in a direction perpendicular to an axial direction of the pin 28. A retaining pin 29 is attached to the through hole 28*c*. The bracket 5*c* of the cross beam 5 is arranged between the bracket portion 17*e* of the receiving seat 17 and the bracket portion 18*e* of the receiving seat 18 and is spaced apart from the bracket portion 17*e* of the receiving seat 17 and the bracket portion 18*e* of the receiving seat 18. To be specific, the pin 28 allows relative axial movements between the bracket 5*c* of the cross beam 5 and each of the bracket portions 17*e* and 18*e* of the receiving seats 17 and 18. A gap between the bracket 5*c* and the receiving seat 18 in the car width direction is smaller than a gap between the plate spring 30 and the receiving seat 17 or 18 in the car width direction and is also smaller than a gap between the tip end portion 16*a* of the axle beam 16 and the receiving seat 17 or 18 in the car width direction.

As shown in FIG. 8, the lid member 25 constituting the coupling portion 19 includes a pair of lid portions 25*a* and a bridge portion 25*b*. The lid portions 25*a* are respectively fixed to lower surfaces of the receiving seats 17 and 18 by bolts to close the lower openings of the fitting grooves 17*a* and 18*a*. The bridge portion 25*b* connects the lid portions 25*a* to each other so as to avoid the tip end portion 16*a* of the axle beam 16. A bottom plate member 26 is provided at a car longitudinal direction middle side of the lid member 25 and fixed to the lower surfaces of the receiving seats 17 and 18 by bolts so as to extend between the receiving seats 17 and 18. The lid member 25 and the bottom plate member 26 are located under the plate spring 30.

According to the configuration explained above, the receiving seat unit 20 projecting from the cross beam 5 toward the axle beams 16 is formed separately from the cross beam 5 and is positioned by contacting the car width direction end portion 5*a* of the cross beam 5. Therefore, as compared to a case where the receiving seat unit 20 is formed integrally with the bogie frame 5 by welding, for example, an accumulated dimension error of the parts of the bogie 1 can be easily adjusted. Thus, the bogie 1 can be easily produced with a high degree of accuracy.

The receiving seats 17 and 18 of the receiving seat unit 20 are located under the cross beam 5, extend in the car longitudinal direction, and realize both the coupling to the axle beam 16 located at one of car longitudinal direction sides and the coupling to the axle beam 16 located at the other car longitudinal direction side. Therefore, dimensional accuracy of the axle beams 16 at front and rear sides improves, and the number of parts and assembling man-hours can be reduced. The cross beam 5 and the receiving seats 17 and 18 are coupled to each other by the pins 28. Therefore, at the time of an abnormality such as derailment, the receiving seats 17 and 18 which are formed separately from the cross beam 5 can be prevented from being separated from the cross beam 5.

The fitting portion 24*c* of receiving seat unit 20 is fitted in the fitted portion 5*e* of the cross beam 5 in the upper/lower direction. Therefore, the receiving seat unit 20 can be easily positioned relative to the cross beam 5 in the horizontal direction. Regarding the receiving seat unit 20, not the base plate portion 24*a* located between the receiving seats 17 and 18 but the projecting plate portion 24*b* projecting toward one side is fastened to the cross beam 5 by the bolts. Therefore, in a state where the plate spring 30 is arranged between the receiving seats 17 and 18, the receiving seat unit 20 can be attached by attaching the bolts and can be detached by detaching the bolts. The plate spring 30 is provided at a position sandwiched between the receiving seats 17 and 18 and overlaps the receiving seats 17 and 18 in a side view. Therefore, the bogie 1 can be reduced in size in the upper/lower direction.

The present invention is not limited to the above embodiment. Modifications, additions, and eliminations may be made within the scope of the present invention. The present embodiment has explained the bogie 1 which does not include the side sills but includes the plate springs 30. However, a bogie including side sills may be adopted. The present embodiment has explained the axle beam type coupling device as the coupling device 15, but the coupling device of the other type may be adopted.

INDUSTRIAL APPLICABILITY

As above, the railcar bogie according to the present invention has the above-described excellent effects. It is useful to widely apply the present invention to railcar bogies which can achieve the significance of these effects.

REFERENCE SIGNS LIST

1 bogie
4 bogie frame
5 cross beam
5*b* fitting portion
5*c* bracket
5*d* pin hole
5*e* fitted portion
6 axle
8 bearing
9 axle box
15 coupling device
16 axle beam (first member)
17, 18 receiving seat
17*e*, 18*e* bracket portion
17*f*, 18*f* pin hole
19 coupling portion
20 receiving seat unit (second member)
24*c* fitting portion
28 pin
30 plate spring

The invention claimed is:

1. A railcar bogie comprising:

a bogie frame including a cross beam supporting a carbody of a railcar;

a pair of axles respectively arranged at both sides of the cross beam in a car longitudinal direction and extending in a car width direction;

bearings provided at both car width direction sides of each of the axles and rotatably supporting the axles;

axle boxes respectively accommodating the bearings; and axle beam coupling devices coupling the axle boxes and the bogie frame to one another, each of the axle beam coupling devices including an axle beam projecting from the axle box to the bogie frame and extending in the car longitudinal direction, a receiving seat unit projecting from the bogie frame to the axle beam and extending in the car longitudinal direction, and a coupling portion coupling the axle beam and the receiving seat unit to each other, and the receiving seat unit being formed separately from the bogie frame and positioned by contacting the bogie frame.

2. The railcar bogie according to claim 1, wherein:

the receiving seat unit is located under the cross beam and extends in the car longitudinal direction; and one of end portions of the receiving seat unit which is located at one of sides in the car longitudinal direction is coupled to the axle beam connected to the axle box located at the one side, and the other end portion of the receiving seat unit which is located at the other side in the car longitudinal direction is coupled to another axle beam connected to the axle box located at the other side.

3. The railcar bogie according to claim 1, wherein:

each of the bogie frame and the receiving seat unit includes a bracket portion having a pin hole; and a pin is inserted into the pin hole of the bogie frame and the pin hole of the receiving seat unit.

4. The railcar bogie according to claim 1, wherein:

the receiving seat unit includes a fitting portion;

the bogie frame includes a fitted portion in which the fitting portion is fitted; and the receiving seat unit is positioned relative to the bogie frame in a horizontal direction by fitting the fitting portion in the fitted portion from above.

5. The railcar bogie according to claim 1 further comprising plate springs respectively contacting and supporting both car width direction end portions of the cross beam from below and extending in the car longitudinal direction, both longitudinal direction end portions of each of the plate springs being respectively supported by the axle boxes, the receiving seat unit is located at both sides of the plate spring in the car width direction.

6. The railcar bogie according to claim 1, wherein:

the bogie frame and receiving seat unit are provided with bolt holes at corresponding positions; and the bogie frame and the receiving seat unit are fixed to one another by fastening bolts to the bolt holes.

* * * * *